US006299005B1

(12) United States Patent
Higgins

(10) Patent No.: US 6,299,005 B1
(45) **Date of Patent: *Oct. 9, 2001**

(54) CLOSURE

(75) Inventor: Phillip Higgins, Rowvill (AU)

(73) Assignee: Amcor Packaging (Australia) Pty. LTD, Comberwell (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/471,748

(22) Filed: Dec. 23, 1999

(30) Foreign Application Priority Data

Dec. 24, 1998 (AU) ..... PP7929

(51) Int. Cl.[7] ..... B65D 43/16; B65D 43/22; B65D 41/48

(52) U.S. Cl. ..... 215/237; 215/245; 215/253; 215/305; 215/306; 215/317

(58) Field of Search ..... 215/272, 237, 215/238, 239, 242, 244, 245, 253, 254, 258, 284, 287, 295, 303, 304, 305, 306, 316, 317; 220/326, 915, 833, 834, 835, 375

(56) References Cited

U.S. PATENT DOCUMENTS

D. 970,037 * 8/2000 Gilfillan ..... 215/305
2,778,520 * 1/1957 Hyde, Jr. ..... 215/305
3,405,830 * 10/1968 Hayashida .
3,603,473 * 9/1971 Winberg ..... 215/305
4,531,650 * 7/1985 Friendship .
5,251,770 * 10/1993 Bartley et al. ..... 215/305 X
5,348,181 * 9/1994 Smith et al. ..... 220/326 X
5,842,592 * 12/1998 Beck ..... 215/253

FOREIGN PATENT DOCUMENTS

2452766 * 5/1976 (DE) .

* cited by examiner

*Primary Examiner*—Nathan J. Newhouse
(74) *Attorney, Agent, or Firm*—Burns, Doane, Swecker & Mathis LLP

(57) ABSTRACT

A closure (1) for a container is disclosed. The closure has a cap (11) which includes a top wall (13), a side wall (15), and a closure member (25) that can be moved into a closed position in which the closure member engages a reaction surface of the container. In this closed position the closure member resists release of the cap from the container and generates a downwardly-acting force which results in a seal being formed between the cap and a rim (71) of the container. The closure member is connected to the side wall so that it can move in an overcenter action between an open position in which the closure member does not engage the reaction surface and the closed position in which the closure member engages the reaction surface.

19 Claims, 7 Drawing Sheets

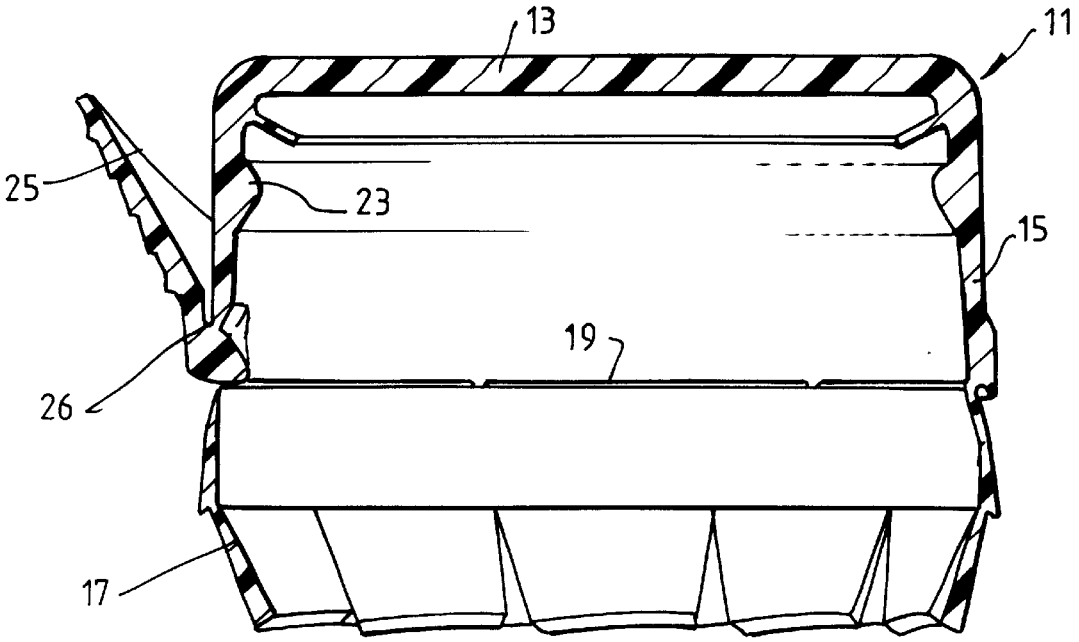
FIG. 19.
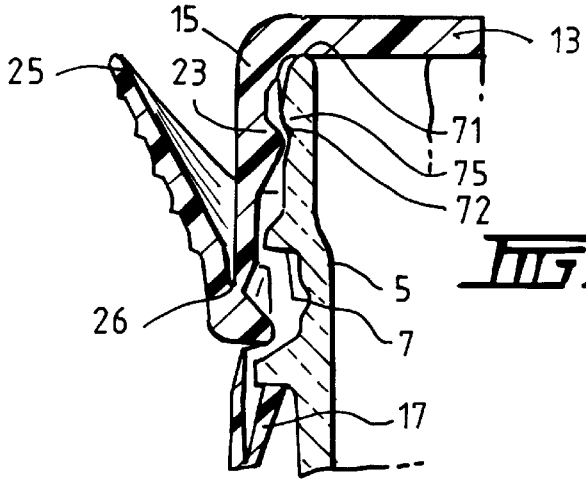
FIG. 20.
FIG. 22.
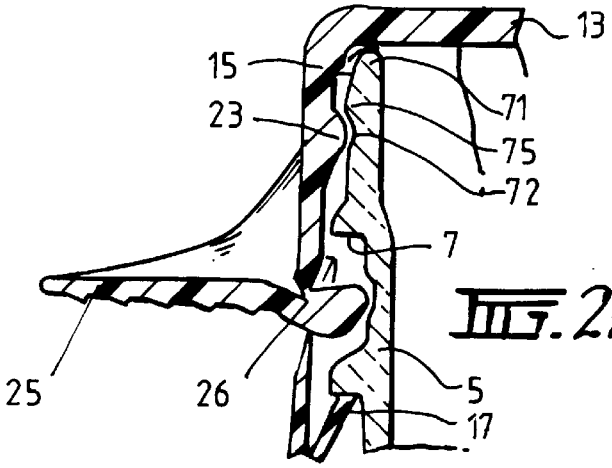
FIG. 21.
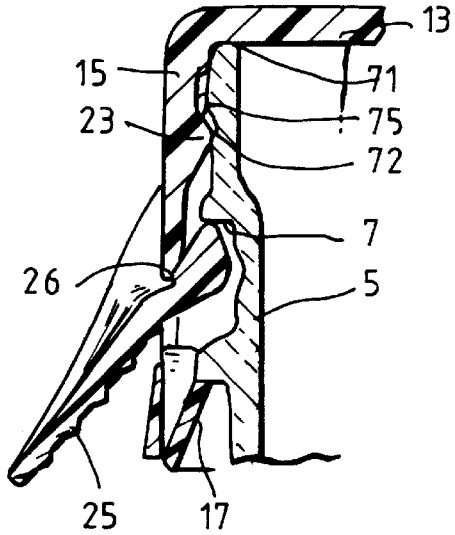

CLOSURE

The present invention relates to a closure for a container.

The present invention relates particularly, although by no means exclusively, to a closure that is an alternative to conventional internally threaded closures that are adapted to be positioned on complementary externally threaded necks of aerated beverage containers.

The threaded necks of aerated beverage containers formed from plastics materials, such as polyethylene terepthalate, account for a significant proportion, typically 10%, of the total weight of the containers. The relatively high materials requirements for the container necks is necessary to provide neck constructions that can cooperate with threaded closures to provide an adequate seal to withstand internal pressures generated when containers are filled with an aerated beverage and to enable adequate resealing of the containers after the containers have been opened and portions of the contents consumed.

It can readily be appreciated that the relatively high materials requirements for the container necks is a substantial cost component in the manufacture of the containers.

An object of the present invention is to provide an alternative closure that is suitable for use with containers for aerated beverages.

According to the present invention there is provided a closure for a container, the container having an opening, the closure comprising a cap to close the container opening, the cap including:

(i) a top wall, (ii) a side wall, (iii) a closure member that can be moved into a closed position in which the closure member engages a reaction surface of the container and thereby resists release of the cap from the container and generates a downwardly-acting force which results in a seal being formed between the cap and a rim of the container which defines the container opening, the closure member being connected to the side wall so that it can move in an overcentre action between an open position in which the closure member does not engage the reaction surface and the closed position in which the closure member engages the reaction surface.

It is preferred that the reaction surface be part of an outer surface of the container.

The reaction surface may be of any suitable configuration.

It is preferred that the reaction surface be in the form of an undercut surface in the outer surface of the container.

It is preferred that the undercut surface extend around the circumference of the container at that location on the container.

The closure member may be any suitable configuration.

It is preferred that the closure member be a lever.

It is preferred particularly that the lever be connected at its fulcrum to the side wall of the cap and comprises:

(i) one end for contacting the reaction surface; and p1 (ii) an opposed end that can be manipulated by a person to move the closure member between the open and the closed positions.

The closure may include an internal circumferential bead on the side wall of the cap which contacts a section of the outer surface of the container with an interference fit when the closure member is in the open position and forms a seal between the cap and the container. Thus, with this arrangement the closure seals the container opening even in situations where the closure member is in the open position.

It is preferred that the bead contact the section of the outer surface of the container with the interference fit after being snap-fitted over an external bead of the container.

Preferably the external bead of the container is at a location that is closer than the reaction surface to the container opening.

It is preferred that the closure means comprise two webs, one on each side of the lever and that the webs connect together the side wall of the cap and one or more of sections of the lever located between the fulcrum and the said opposed end of the lever.

It is preferred that the joint between each web and the side wall, as viewed in front elevation, be upwardly curved away from the lever. The applicant has found that the upward curve of the webs contributes to the overcentre action of the lever.

It is preferred that the cap be formed from a plastics material.

It is preferred that the closure further comprises a tamper evident means.

It is preferred that the tamper evident means comprises a band connected to the cap by frangible bridges.

According to the present invention there is also provided an assembly of a container and a closure, as described above.

The present invention is described further by way of example with reference to the accompanying drawings of which:

FIG. 19 is a vertical section of the closure shown in FIGS. 17 and 18 with the tamper evident petals in an as-moulded inoperative position; and FIGS. 20 to 22 are a series of detailed sections which illustrate the range of movements of the closure member of the closure shown in FIGS. 17 to 19 from an open position to a closed position.

The preferred embodiments of the closure of the present invention shown in the figures are adapted particularly for use in conjunction with containers for aerated beverages, and the preferred embodiments are described in this context.

Nevertheless, the closure of the present invention is not limited to this application and may be used in conjunction with containers for aerated and non-aerated beverages.

The container, which is generally identified by the numeral 3, shown in the figures comprises a neck 5 that defines an opening of the container 3.

Figure 1:
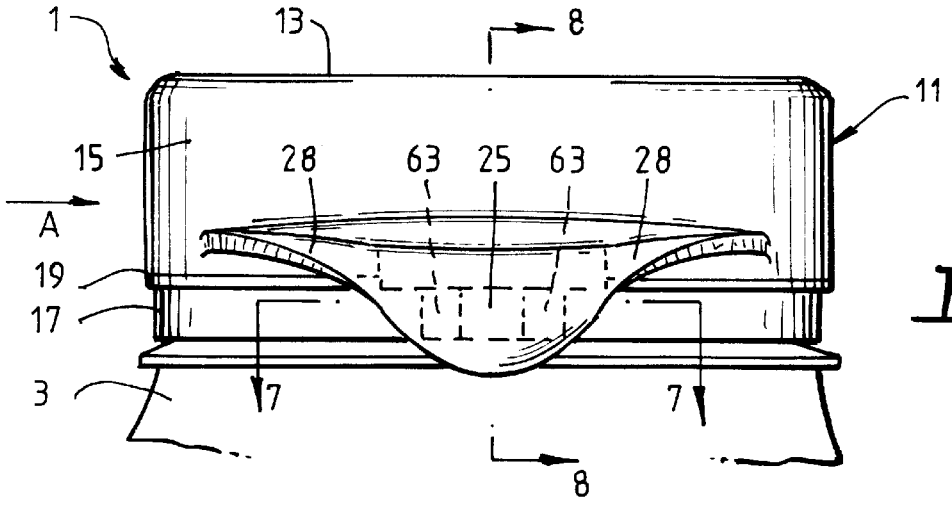
FIG. 1 is a side elevation of one preferred embodiment of a closure in accordance with the present invention located in a closed position on a container neck.
Figure 2:
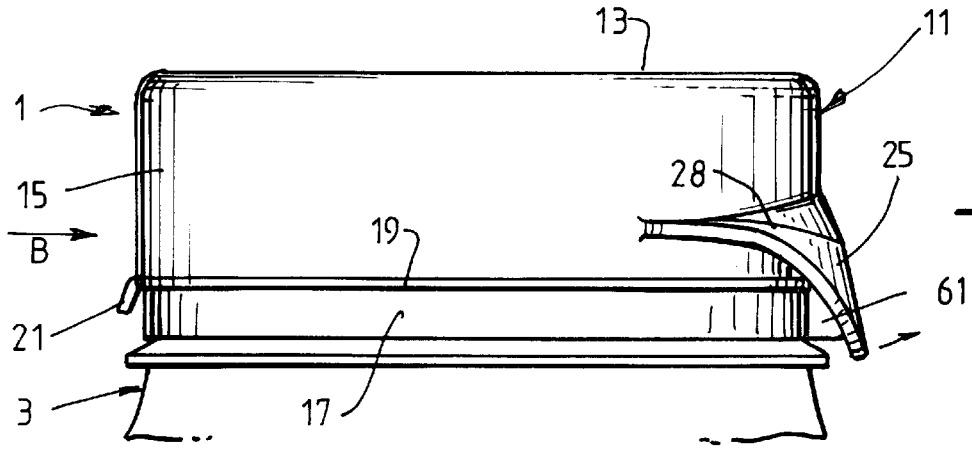
FIG. 2 is a side elevation of the closure/container neck assembly shown in the direction of the arrow A in FIG. 1.
Figure 8:
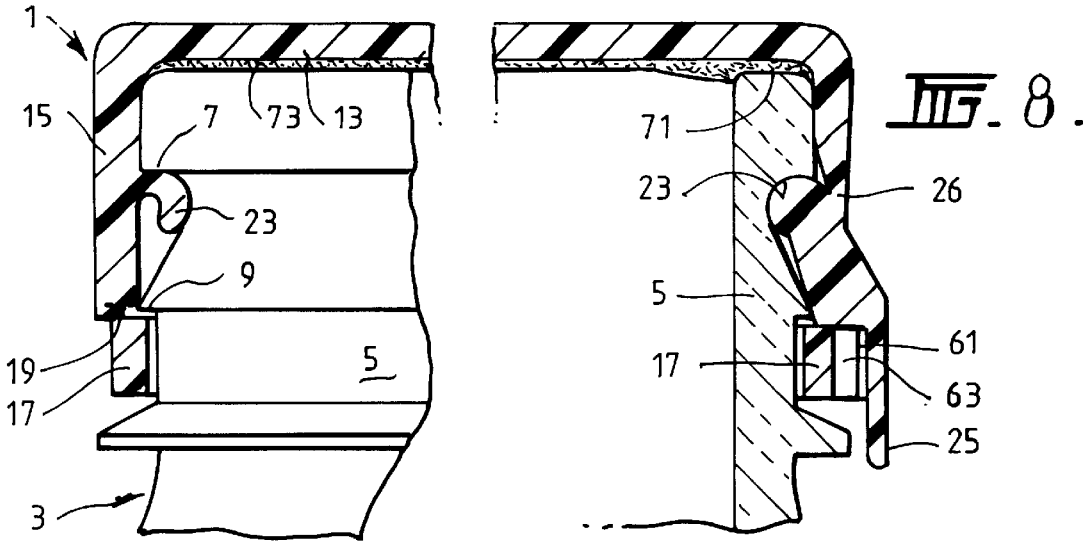
FIG. 8 is section along the line 8—8 in FIG. 1.

FIGS. 1, 2 and 8 illustrate one preferred embodiment of the closure 1 in a closed position on the container neck 5, ie in a position in which the closure 1 seals the container opening.

Figure 9:
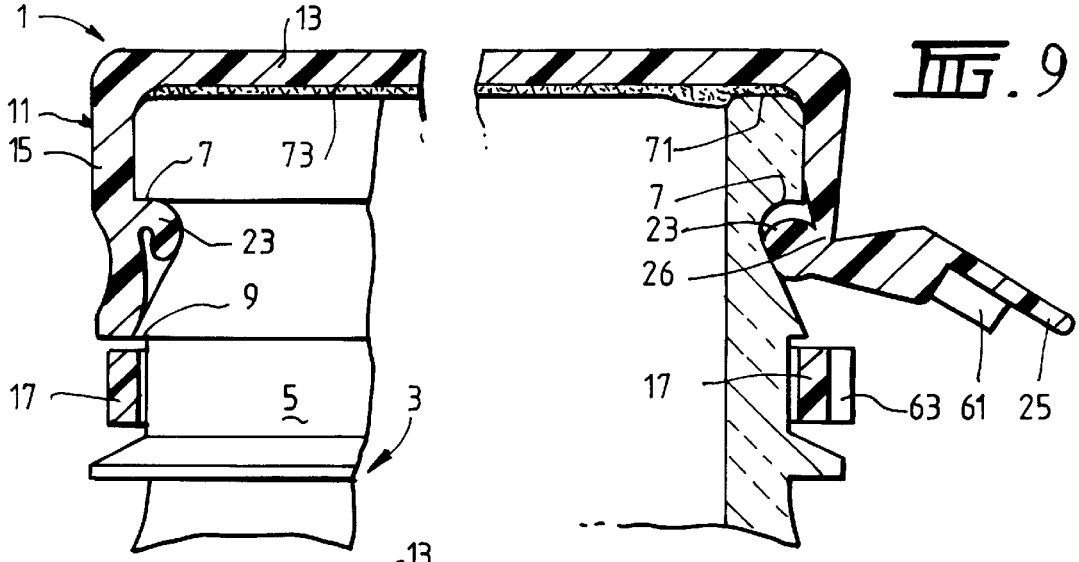
FIG. 9 is a section along the line 9—9 in FIG. 5.
Figure 10:
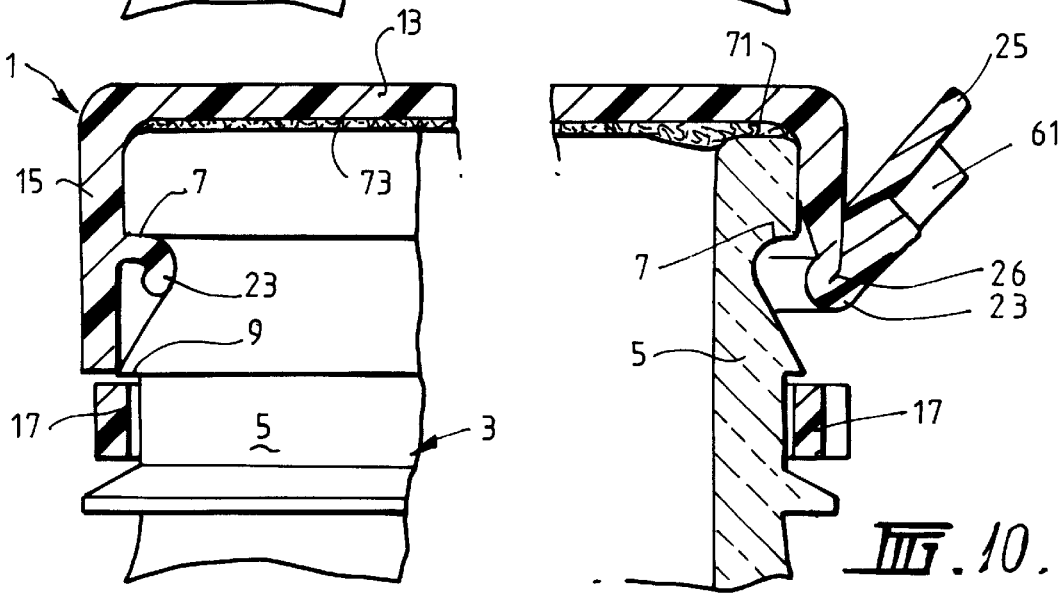
FIG. 10 is a section along the line 10—10 in FIG. 6.
Figure 14:
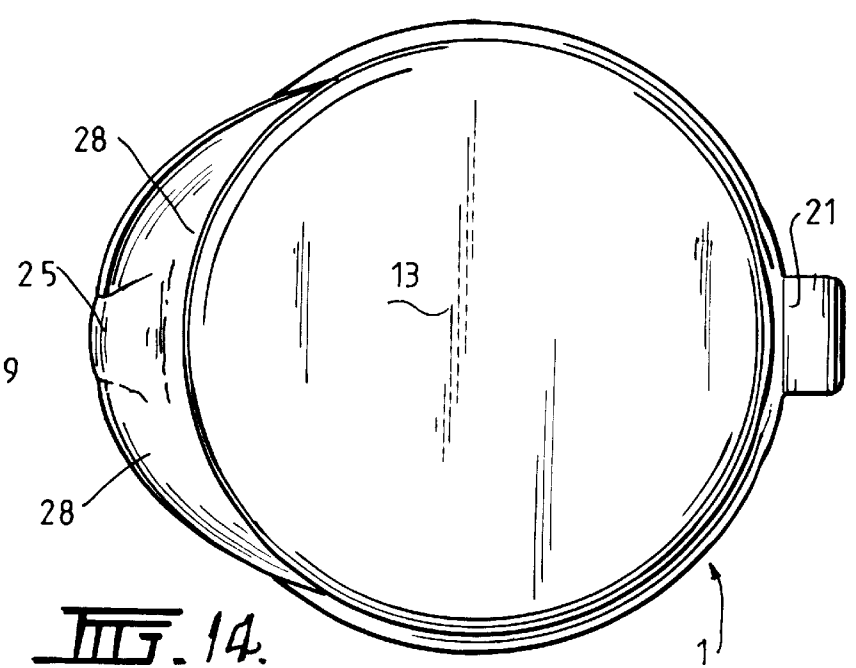
FIG. 14 is a top plan view of the closure shown in FIG. 13.
Figure 15:
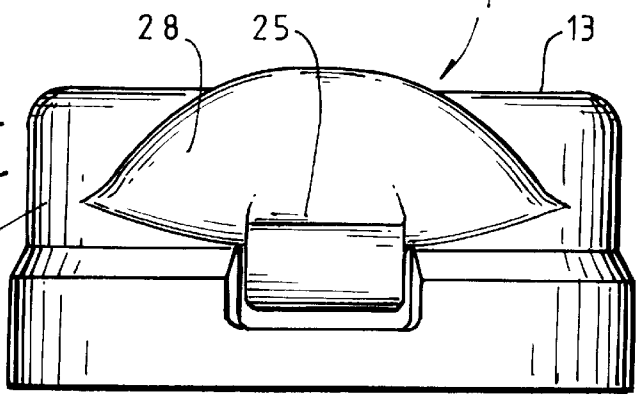
FIG. 15 is a front elevation of the cap of the closure shown in FIGS. 13 and 14.
Figure 13:
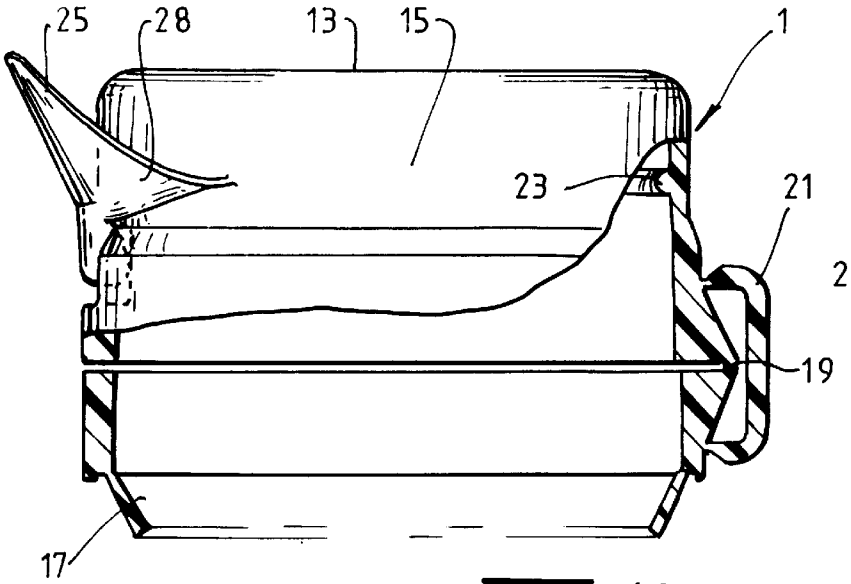
FIG. 13 is a partial cross-section, partial side elevation, of another preferred embodiment of a closure in accordance with the present invention in an as-moulded form with the closure member in a raised (open) position and the petals of the tamper-evident band extending downwardly.
Figure 16:
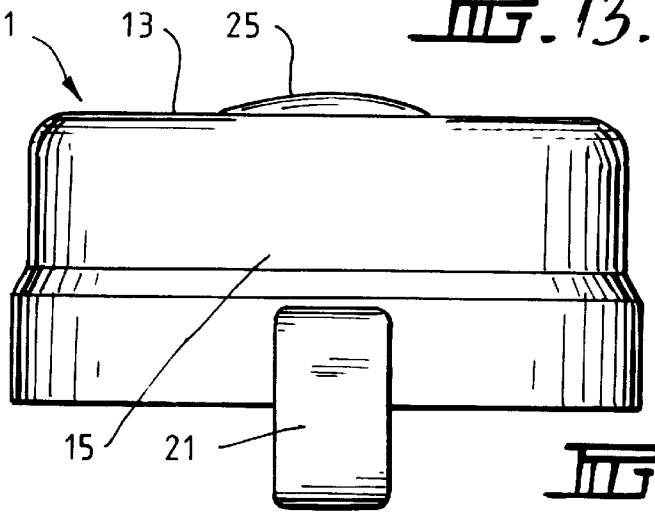
FIG. 16 is a rear elevation of the cap of the closure shown in FIGS. 13 to 15.
Figure 17:
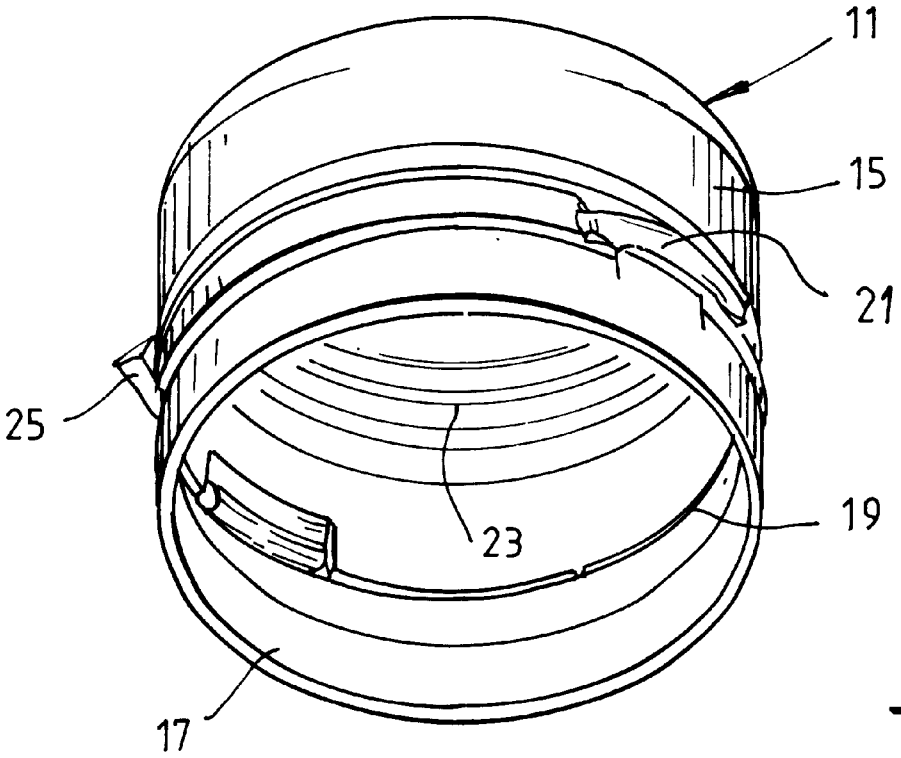
FIGS. 17 and 18 are perspective views of another preferred embodiment of a closure in accordance with the present invention with the closure member in a raised (open) position and the tamper evident band in an operative position.
Figure 18:
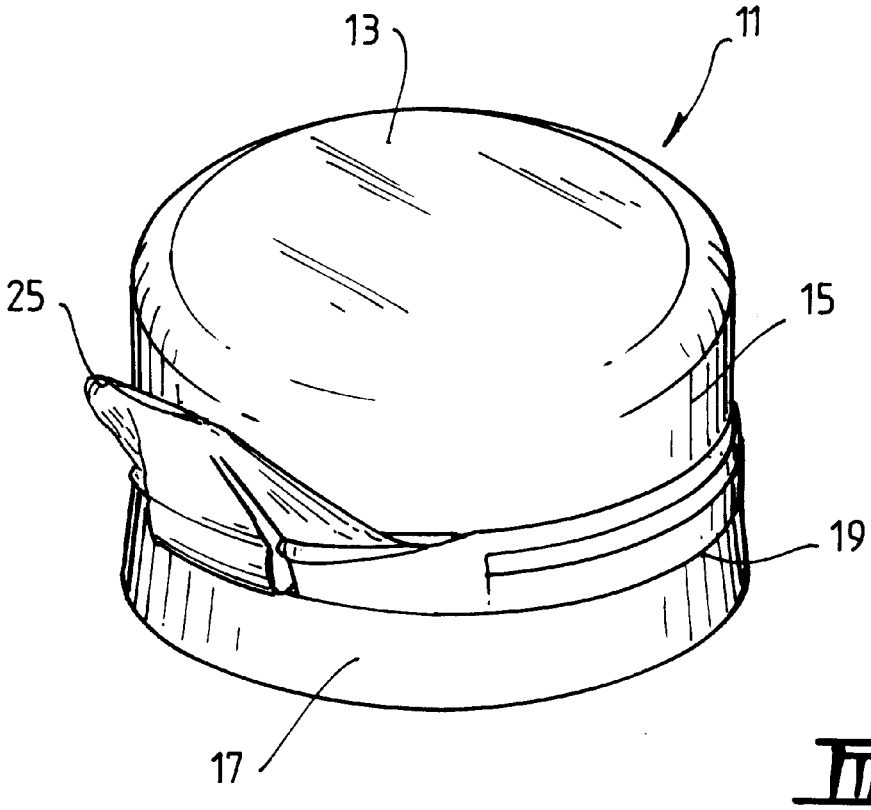

With particular reference initially to FIG. 8, and as is also shown in FIGS. 9 and 10, the outer surface of the container neck 5 comprises a circumferential undercut 7 which, as is described hereinafter, cooperates with a closure member of the closure 1.

With further reference to FIG. 8, the outer surface of the neck 5 further comprises a shoulder 9 which, as is hereinafter described, retains a tamper-evident band of the closure 1 on the container 3.

With reference generally to FIGS. 1 to 12, the closure 1 comprises a cap, generally identified by the numeral 11, having a top wall 13 and a downwardly depending side wall 15.

The closure 1 further comprises a tamper-evident band 17 which is connected to the lower edge of the side wall 15 by frangible bridges 19. The tamper-evident band may be of any suitable configuration. In the arrangement shown, the diameter of the band 17 is selected to be less than that of the shoulder 9. In use, when the closure 1 is positioned initially on the container 3, the band 17 is axially below the shoulder 9 so that the wider diameter of the shoulder 9 retains the band 17 on the container 3.

The above-described arrangement is such that the closure can be released from the closed position on the container neck 5 by lifting the cap 11 upwardly. The shoulder 9 of the container neck 5 limits upward axial movement of the band 17 and, as a consequence, sufficient lifting movement of the cap 11 severs the bridges 19 that interconnect the cap 11 and the band 17.

The cap 11 and the tamper-evident band 17 are interconnected by a hinge member 21. In effect, the hinge member 21 tethers the cap 11 to the container 3 after the cap 11 is released from the container neck 5.

The cap 11 comprises a closure member in the form of a lever 25 which, when the closure is in the closed position shown in FIGS. 1, 2 and 8, engages the undercut 7 and thereby:

(i) resists release of the cap 11 from the container; and (ii) generates a downward-acting force which positions the top wall 13 of the cap 11 firmly against the rim 71 of the container neck 5 and forms a seal between the closure and the container.

In order to improve the quality of this seal, a layer 73 of a suitable sealing compound is provided on the inner surface of the top wall 13 in the region of the rim 71 and is sandwiched between the top wall 13 and the rim 71 when the closure is in the closed position.

Figure 5:
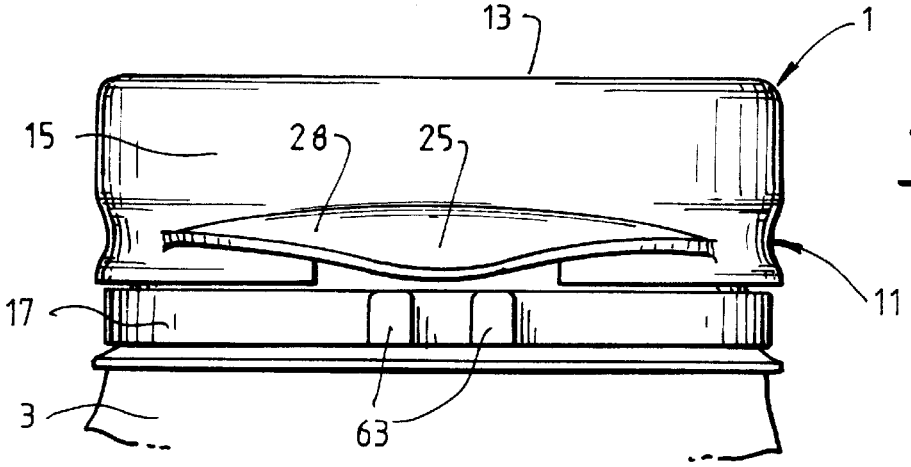
FIG. 5 is a side elevation of the closure/container—in the orientation of FIG. 1—with the closure member in a partially raised position.
Figure 11:
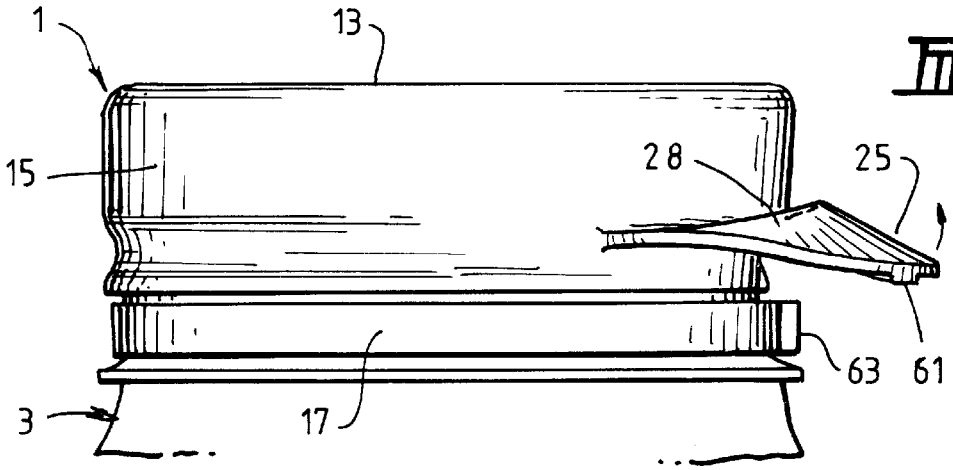
FIG. 11 is a side elevation of the closure/container in the direction of the arrow C in FIG. 5.
Figure 12:
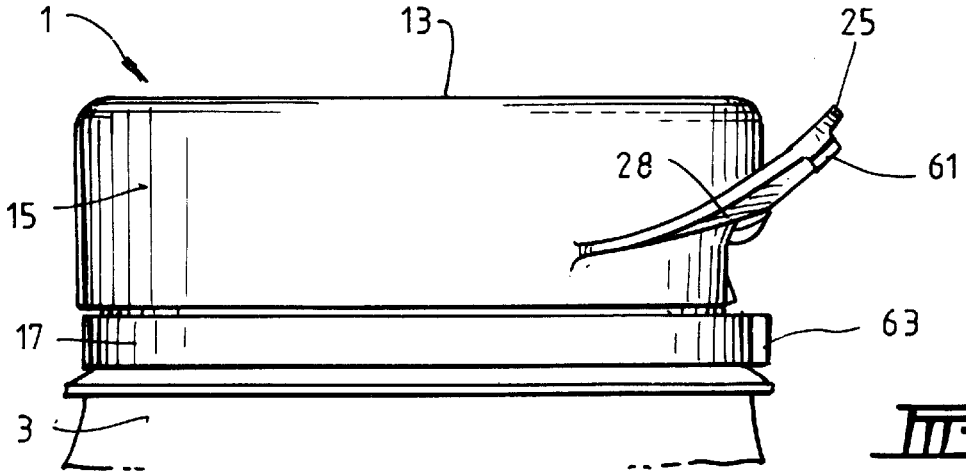
FIG. 12 is a side elevation on the closure/container in the direction of arrow D in FIG. 6.
Figure 3:
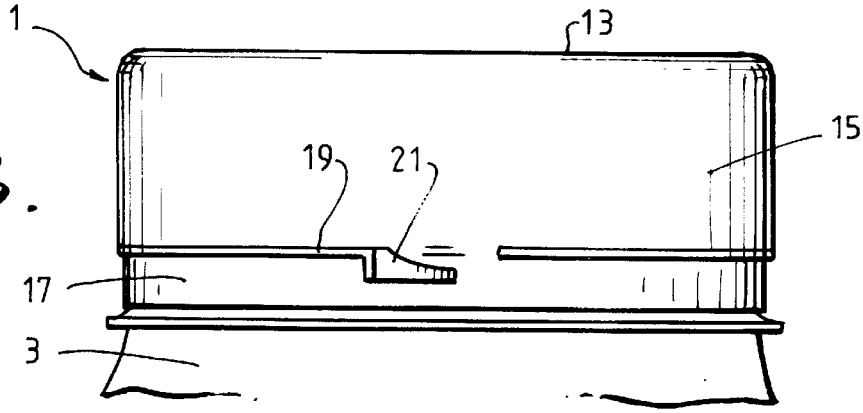
FIG. 3 is a side elevation of the closure/container assembly in the direction of the arrow B in FIG. 2.
Figure 4:
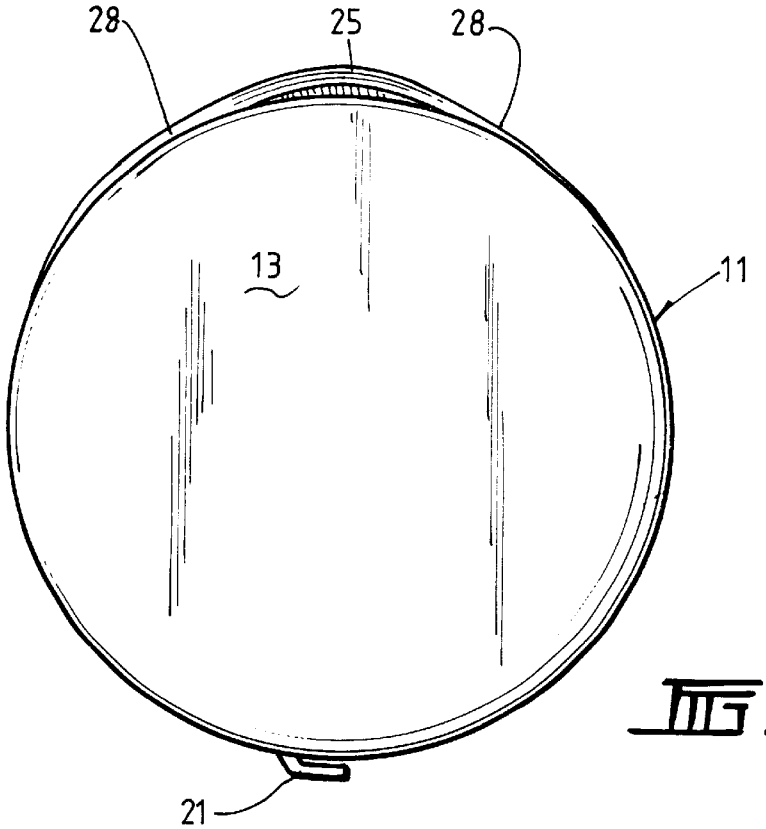
FIG. 4 is a top plan view of the closure.

More particularly, the lever 25 is connected at its fulcrum 26 (FIGS. 8–10) to the side wall 15. An inwardly extending end of the lever 25 is shaped to conform to the profile of the undercut surface 7 and an outwardly extending end is formed as a member that can be manipulated by a person to move the lever, as required, between a raised (open) position shown in FIGS. 6, 10 and 12 and a lowered (closed) position shown in FIGS. 1, 8 and 12. An intermediate position of the lever 25 is illustrated in FIGS. 5, 9 and 11.

In addition to the connection between the lever 25 and the side wall 15 at the fulcrum 26 of the lever 25, the cap 15 further comprises a pair of webs 28, one on each side of the lever 25, that connect together the lever 25 and the side wall 15.

The effect of the webs 28 is to control the movement of the lever 25 between the raised and lowered positions to be via an overcentre action in which the lever 25 snaps firmly into the lowered position.

The cap 11 comprises a circumferential bead 23 which extends inwardly from the side wall of the cap 11. The bead 23 extends substantially around the circumference of the side wall 15 and is positioned so that it contacts the undercut 7—as can best be seen in FIGS. 8 to 10. The bead 23 contacts the undercut 7 with an interference fit when the lever 25 is in the raised position and, consequently, the bead 23 forms a seal between the closure and the container when the lever is in this position.

When the lever 25 is in the raised position the cap 11 can readily be lifted clear of the container neck 5 to allow the contents of the container 3 to be dispensed. In this connection, with reference to FIG. 10, in the raised position of the lever 25 the inwardly extending end of the lever 25 does not engage the neck 5, and in this position the bead 23 can be manipulated over the undercut 7 so that the cap 11 can easily be lifted away from the neck 5 to allow access to the container.

With further reference to FIG. 10, and with reference to FIGS. 8 and 9, downward movement of the lever 25 from the raised position shown in FIG. 10 to the lowered position shown in FIG. 8 rotates inwardly the section of the bead 23 that forms the inwardly extending end of the lever 25 initially against the neck 5 and then progressively upwardly and inwardly to engage the undercut 7. This engagement of the lever 25 and the undercut surface 7 has the effect of retaining the cap 11 of the container and of generating the above-described downwardly acting force which results in the seal between the top wall 13 and the container rim 71.

Figure 6:
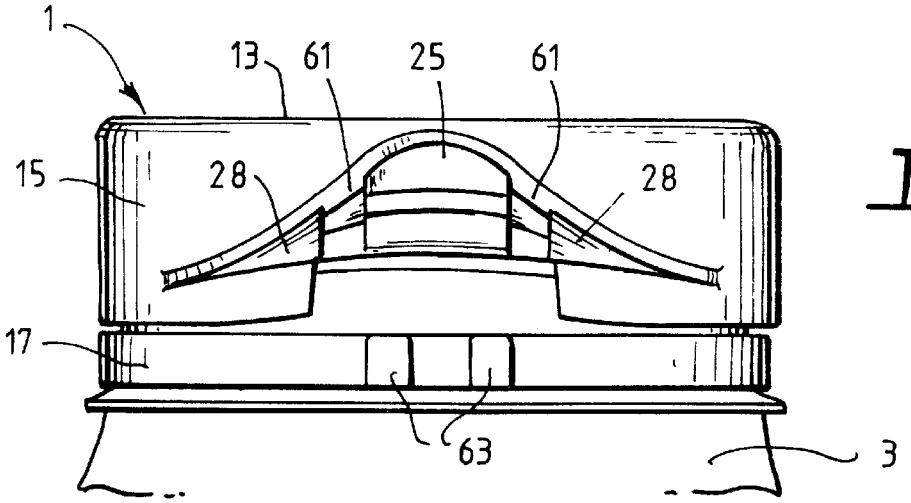
FIG. 6 is a side elevation of the closure/container—in the orientation of FIGS. 1 and 5—with the closure member in a fully raised (open) position.
Figure 7:
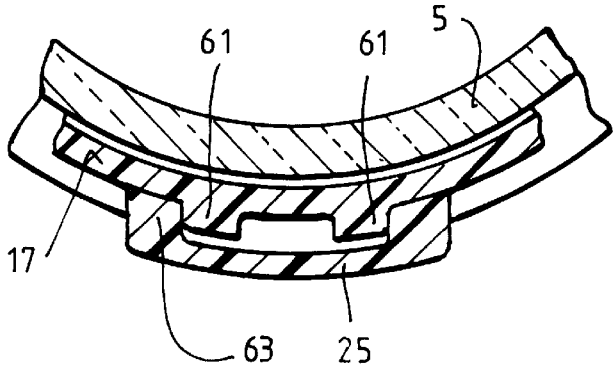
FIG. 7 is a section along the line 7—7 in FIG. 1.

With particular reference to FIGS. 5, 6, and 7, the lever 25 comprises a pair of spaced-apart inturned flanges 61 which are adapted to frictionally engage the outer surfaces of a pair of outwardly extending projections 63 on the tamper-evident band 17 when the lever 25 is in the lowered position. The frictional engagement assists in retaining the lever 25 in the lowered position.

The preferred embodiment of the closure shown in FIGS. 13 to 16 is similar conceptually and in detail to the embodiment shown in FIGS. 1 to 12, and the same reference numerals are used to describe the same parts/components in both embodiments.

One particular feature of the embodiment shown in FIGS. 13 to 16 is that the join between each web 28 and the side wall 15 defines an upturned curve from the lever 25—as viewed in the front elevation. The applicant has found that this feature contributes to the overcentre action of the lever 25 and brings the lever 25 closely against the side wall 15 when the lever 25 is in the closed position.

Another particular feature of the embodiment shown in FIGS. 13 to 16 is that the bead 23 and the bead 23 is not positioned to contact the undercut 7. Specifically, the bead 23 is positioned above the level of the undercut 7 is formed as a continuous bead and thereby improves the quality of the seal between the closure and the container when the lever 25 is in the raised position. With this arrangement the undercut 7 is provided to engage only the lever 25.

The preferred embodiment of the closure shown in FIGS. 17 to 22 is similar conceptually to the embodiments shown in FIGS. 1 to 16 and is similar in detail to the embodiment shown in FIGS. 13 to 16. One particular feature of the embodiment is that the container neck 5 is formed with an outwardly extending bead 75 which has an undercut surface 72 that is contacted by the bead 23 when the closure is positioned on the container. As a consequence, in order to initially locate the closure on the container after the container has been filled, which is done with the lever 25 in the raised position, it is necessary to snap-fit the bead 23 over the bead 75. This snap-over interference fit of the bead 23 improves the seal formed between the bead 23 and the undercut surface 77 while the lever 25 is in the raised position.

As with the other embodiments there is a further (and primary) seal formed by contact of the top wall 13 against the rim 71 of the container neck 5 when the lever 25 is in the closed position.

The above-described closures 1 have a number of important features.

Firstly, the closures 1 are an alternative to the conventional screw threaded arrangement and makes it possible to reduce substantially the materials requirements for container necks.

Furthermore, the levers 25 make it possible to reseal the containers 3 in a secure manner.

Furthermore, the overcentre action of the levers 25 firmly locates the levers 25 in the closed position and holds the levers 25 closely against the side walls 15 of the caps 11. This minimises the possibility of the levers 25 being accidentally displaced.

Many modifications may be made to the preferred embodiment described above without departing from the spirit and scope of the present invention.

What is claimed is:

1. A closure for a container, the closure comprising:

a cap, the cap including, a topwall, and a side wall;

a closure member, wherein the closure member can be moved into a closed position in which the closure member engages a reaction surface and thereby resists release of the cap, the closure member further generates a downwardly-acting force which results in a seal being formed between the cap and a container opening, the closure member being integrally formed with the side wall so that the closure member can move in an overcentre action between an open position in which the closure member does not engage the reaction surface and the closed position in which the closure member engages the reaction surface.

2. The closure defined in claim 1, wherein the reaction surface is part of an outer surface of a container.

3. The closure defined in claim 2 wherein the reaction surface is in the form of an undercut surface in the outer surface of the container.

4. The closure defined in claim 3, wherein the undercut surface extends around a circumference of the container.

5. The closure defined in claim 1, wherein the closure member is a lever.

6. The closure defined in claim 5 wherein the lever further includes, one end for contacting the reaction surface, and an opposed end that can be manipulated by a person to move the closure member between the open and the closed positions, wherein the lever is connected at its fulcrum to the side wall of the cap.

7. The closure defined in claim 5 wherein the closure means comprise two webs, one on each side of the lever wherein the webs connect together the side wall of the cap and one or more sections of the lever located between the fulcrum and the said opposed end of the lever.

8. The closure defined in claim 2, wherein the closure further includes an internal circumferential bead on the side wall of the cap which contacts a section of the outer surface of the container with an interference fit when the closure member is in the open position and forms a seal between the cap and the container.

9. The closure defined in claim 8 wherein the bead contacts the section of the outer surface of the container with the interference fit after being snap-fitted over an external bead of the container.

10. The closure defined in claim 9 wherein the external bead of the container is at a location that is closer than the reaction surface to the container opening.

11. The closure defined in any one of the preceding claims further includes a tamper evident means.

12. The closure defined in claim 1, wherein the closure further includes a tamper resistant ring disposed adjacent said cap wherein said tamper resistant ring is detachably connected to a distal end of said cap.

13. The closure defined in claim 12, wherein the cap further includes a hinge, wherein a first end of the hinge is fixedly attached to the side wall of the cap and a second end is fixedly attached to the tamper resistant ring.

14. The closure according to claim 1, wherein said closure is constructed of plastic material.

15. A closure for containers, the closure comprising:

a cap, said cap defined by a top wall and a side wall, said cap formed having a generally cylindrical shape;

a closure means, wherein said closure means is unitarily formed with said side wall, said closure means movable in an overcenter action between an open position and a closed position;

a tamper resistant element, wherein said tamper resistant element is detachably attached to said cap by a least one frangible element; and a hinge, wherein said hinge is unitarily formed with said cap and said tamper resistant ring.

16. The closure defined in claim 15, wherein the closure means includes a lever, the lever further including one end for contacting the reaction surface, and an opposed end that can be manipulated by a person to move the closure member between the open and the closed positions.

17. The closure according to claim 15, wherein said closure is constructed of a plastic material.

18. A closure for containers, the closure comprising:

a cap, said cap defined by a top wall, a side wall, a tamper resistant element, wherein said cap is formed having a generally cylindrical shape; and a hinge, wherein said hinge is unitarily formed with said cap and said tamper resistant element; and a closure means, wherein said closure means is unitarily formed with said side wall and said closure means movable in an overcenter action between an open position and a closed position.

19. The closure according to claim 18, wherein said closure is constructed of a plastic material.

* * * * *